United States Patent [19]

Syvakari

[11] 3,949,583

[45] Apr. 13, 1976

[54] PRESS CONTAINING A PRESSURE CELL WITH A FLEXIBLE DIAPHRAGM AND A FORMING PAD INFLUENCED BY SAID DIAPHRAGM

[75] Inventor: Pertti Syvakari, Helsingborg, Sweden

[73] Assignee: Allmanna Svenska Elektriska Aktiebolaget, Vasteras, Sweden

[22] Filed: Dec. 5, 1974

[21] Appl. No.: 529,891

[30] Foreign Application Priority Data

June 18, 1974 Sweden ..... 7407992

[52] U.S. Cl. ..... 72/63; 92/102

[51] Int. Cl.[2] ..... B21D 22/12

[58] Field of Search ..... 72/63, 453; 92/92, 98, 92/102; 100/211, 212

[56] References Cited

UNITED STATES PATENTS

| | | | |
|---|---|---|---|
| 2,669,209 | 2/1954 | Hoffman | 72/63 |
| 2,771,850 | 11/1956 | Wheelon | 72/63 |
| 2,786,423 | 11/1956 | Coffey | 92/102 |
| 3,093,086 | 6/1963 | Alotz et al. | 92/102 X |
| 3,336,843 | 8/1967 | Griswold | 92/102 X |
| 3,645,139 | 2/1972 | Zauoda | 92/102 X |

*Primary Examiner*—Lowell A. Larson

[57] ABSTRACT

A hydraulic press includes a pressure cell which includes a diaphragm of flexible material with an opening therein surrounded by an annular bead. There are two disc-shaped attachment members for the diaphragm which form between them a first annular groove which fits the bead. The bead and one of the annular members have opposed annular recesses therein, which face a surface of the other annular member. These thus form an annular channel, in which are arranged two sealing rings, one fitting between the bead and one of the attachment members and the other fitting between the two attachment members.

2 Claims, 1 Drawing Figure

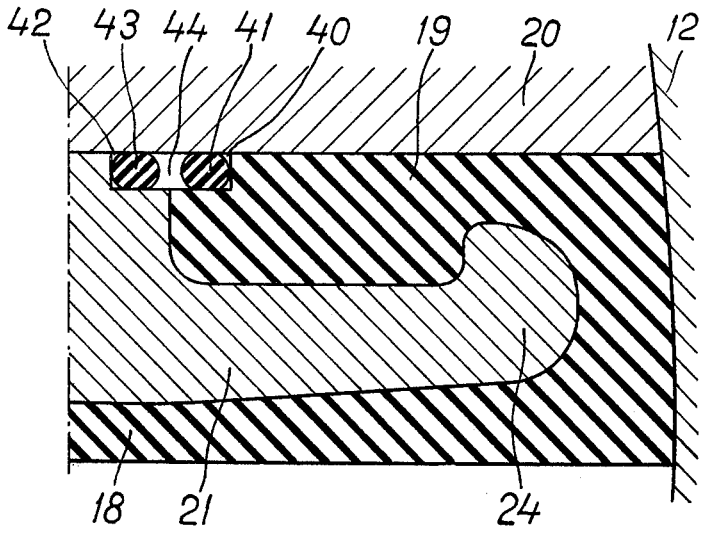
42
43
44
41
40
19
20
12
18
21
24

PRESS CONTAINING A PRESSURE CELL WITH A FLEXIBLE DIAPHRAGM AND A FORMING PAD INFLUENCED BY SAID DIAPHRAGM

RELATED APPLICATIONS

The present invention constitutes an improvement on the sealing arrangement shown in an application of Harry Claesson and Anders Traff Ser. No. 529,892, filed Dec. 5, 1974, corresponding to Swedish application no. 7316456-8, KN4599U, filed Dec. 6, 1973.

BACKGROUND OF THE INVENTION

1. Field of the Invention

The present invention relates to a hydraulic press of the type containing a pressure cell with a diaphragm of flexible material and a pad, influenced by said diaphragm, which is also of a flexible material, said press pressing workpieces against a tool and giving them the desired shape. A press of this kind has normally a very large working surface and is used, for example, in the manufacture of sheet-metal parts in the aviation industry, for example ribs and beams of various kinds.

2. The Prior Art

The press according to the invention constitutes a further development of the press described more closely in the application of Claesson et al., to be filed of even date herewith, corresponding to Swedish patent application 73164568, KN4599U, which has a pressure cell containing a bag-like diaphragm clamped between two disc-shaped attachment members. These attachment members are shaped so as to form an annular groove which is adjusted to an annular bead surrounding the opening of the diaphargm. In the said patent application, a satisfactory seal is secured between the diaphragm and the attachment members by means of a sealing ring in a second groove formed by the diaphragm bead and the attachment members. This construction is a great step forward and provides a considerably more reliable sealing than earlier constructions and makes it possible to raise the working pressure.

SUMMARY OF THE INVENTION

However, it has proved to be possible to improve further the attachment of the diaphragm by constructing said second groove in a particular manner and by inserting two sealing rings in the groove. According to the invention the second groove is formed of the bead of the diaphragm and the attachment members by providing recesses in the inner corners of the bead and in one corner of the attachment member which is located partly inside the diaphragm. In this groove there is a first sealing ring in the recess in the bead sealing between the diaphragm bead and one attachment member and a second sealing ring in the recess in one attachment member sealing between the two attachment members. The sealing rings are preferably of a softer material than the diaphargm. The method of attachment described above makes it possible to clamp the sealing rings between two opposite sides when assembling the pressure cell, thus obtaining a reliably sealing contact.

BRIEF DESCRIPTION OF THE DRAWING

The invention will be described more fully with reference to the accompanying drawing which shows a sectional view of the bead of the diaphragm and the immediately surrounding parts of the attachment members.

DESCRIPTION OF THE PREFERRED EMBODIMENTS

In the figure, 18 designates a bag-like diaphragm with a bead 19 surrounding the diaphragm opening. Of the press itself only a wall 12 is shown which separates a working space. The diaphragm is attached in the press with the help of the two disc-shaped attachment members 20 and 21. Between the outer part 24 of the disc 21 and the disc 20 there is formed a groove fitting to the bead 19. At the abutting corners of the bead 10 and the disc 21 there are annular recesses 40 and 42, an annular channel 44 thus being formed between the attachment members 20 and 21 and the bead 19. In this groove 44 there are two sealing rings, a first ring 41 being arranged in the recess 40 in the bead 19 and a second ring 43 being arranged in the recess 42 in the disc 21. These rings thus seal between the bead 19 and the disc 20 and between the discs 20 and 21, respectively.

I claim:

1. Hydraulic press comprising a pressure cell with a diaphragm of flexible material having an opening and an annular bead, which includes around the opening first and second disc-shaped attachment members for the diaphragm which form between them a first annular groove fitting the bead member, and a pad of flexible material influenced by the pressure cell, for forming plates which are placed on forming pieces in a working space below the pad, the bead member and the first attachment member having opposed annular recesses therein opening at the outer surfaces of said members and the second attachment member having a surface facing said recesses to form therewith an annular channel, and a sealing means in such channel engaging the second attachment member and one of the first attachment members and the bead member.

2. Hydraulic press according to claim 1, having two sealing means arranged in said channel comprising a first sealing ring sealingly bearing against the bead and the first attachment member and a second sealing ring bearing against the two attachment members.

* * * * *